United States Patent [19]

Winheim

[11] Patent Number: 5,059,285

[45] Date of Patent: Oct. 22, 1991

[54] APPARATUS FOR CONTACTING RUNNING WEBS OF FIBROUS MATERIAL WITH FLUIDS

[75] Inventor: Stefan H. Winheim, Frankfurt am Main, Fed. Rep. of Germany

[73] Assignee: V.I.B. Apparatebau GmbH, Maintal, Fed. Rep. of Germany

[21] Appl. No.: 144,934

[22] Filed: Jan. 15, 1988

[30] Foreign Application Priority Data

Jan. 20, 1987 [DE] Fed. Rep. of Germany ..... 3701407

[51] Int. Cl.[5] ..... D21F 5/18

[52] U.S. Cl. ..... 162/290; 34/155; 162/207; 239/562; 239/583

[58] Field of Search ..... 162/207, 272, 290, 359, 162/375; 34/48, 155; 239/562, 567, 583

[56] References Cited

U.S. PATENT DOCUMENTS

| | | | |
|---|---|---|---|
| 3,945,881 | 3/1976 | Speidel | 162/375 |
| 4,268,976 | 5/1981 | Dove | 162/359 |
| 4,358,900 | 11/1982 | Dove | 162/207 |
| 4,422,575 | 12/1983 | Dove | 239/562 |
| 4,662,398 | 5/1987 | Wywailowski et al. | 162/207 |
| 4,915,788 | 4/1990 | Winheim | 162/207 |

*Primary Examiner*—Karen M. Hastings

*Attorney, Agent, or Firm*—Peter K. Kontler

[57] ABSTRACT

An apparatus for directing jets of steam against successive increments of a running web of moist fibrous material in a paper making machine has a housing with an apertured wall, which is adjacent one side of the running web, and several plenum chambers which are adjacent the apertured wall and serve to deliver uniformly distributed steam for penetration through the wall and into contact with the web. At least some plenum chambers contain valves which discharge several annuli of streamlets of steam so that the streamlets first contact the masses of steam in the respective chambers and spread in such chambers prior to reaching the apertured wall. Each valve has a cylindrical body portion with two annuli of steam discharging ports whose axes are inclined at angles of more than 60° with reference to an axis extending at right angles to the apertured wall. Each cylindrical body portion has twelve or more ports to ensure uniform distribution of steam in the respective chamber.

24 Claims, 4 Drawing Sheets

APPARATUS FOR CONTACTING RUNNING WEBS OF FIBROUS MATERIAL WITH FLUIDS

CROSS-REFERENCE TO RELATED CASE

The apparatus of the present invention is similar to that disclosed in the commonly owned copending patent application Ser. No. 082,786 filed Aug. 6, 1987 for "Method of and apparatus for contacting running webs with steam and the like" now abandoned.

BACKGROUND OF THE INVENTION

The invention relates to improvements in apparatus (also called steam boxes) which can be used in paper making and like machines to treat running webs of moist fibrous material. More particularly, the invention relates to improvements in apparatus of the type wherein a housing extends transversely of the path of a running web of moist fibrous material and the housing has one or more plenum chambers adjacent an apertured wall which is placed next to one side of the running web and defines therewith a treating zone receiving steam by way of apertures in the wall and serving to ensure that the steam subjects successive increments of the running web to a predictable treatment.

It is already known to subdivide the interior of the housing of a steam box into a plurality of plenum chambers and to install in the plenum chambers valves which admit steam for distribution within the respective plenum chambers prior to penetration through the apertured wall and into the treating zone. Reference may be had to U.S. Pat. No. 4,422,575 granted Dec. 27, 1983 to Dove for "Steam distributor with plug valve". The plenum chamber of the patented apparatus is flanked by cylindrical steam supplying channels one of which is located upstream and the other of which is located downstream of the plenum chamber in the direction of advancement of the web. The apertured wall has a concave side which faces the path for the web and the wall is provided with a number of apertures for admission of steam into a treating zone between the concave side of the wall and the running web. Each valve of the patented apparatus has a relatively small number of ports, and each port is a large-diameter hole serving for admission of large quantities of steam into the respective plenum chamber. The ports are oriented downwardly, namely toward the apertured wall.

Dove further discloses a flat wall which is formed with several rows of apertures for admission of jets of steam into the treating zone at one side of the running web. A steam supplying conduit extends longitudinally of the plenum chamber above the apertured wall and each valve is connected with an upright pipe having an end close to the apertured wall.

The purpose of the patented apparatus is to raise the temperature of the running web as a result of condensation of steam which is admitted into the treating zone at one side of the web. Such heating of the web facilitates a reduction of its moisture content and thus contributes to simplification and acceleration of the web drying operation. The valves ensure that the treated web can exhibit a desirable moisture profile transversely of the direction of its travel along the apertured wall of the steam box. As a rule, the web is advanced at an elevated or very high speed so that the intervals of time for adequate treatment of successive increments of the running web are very short. Non-uniform treating of successive increments of the web results in considerable fluctuations of temperature and entails non-uniform drying of the paper strip which is obtained from the web. It has been found that heretofore known apparatus of the type known as steam boxes cannot ensure predictable heating of all regions of a running web, especially if the web is transported at an elevated speed.

OBJECTS AND SUMMARY OF THE INVENTION

An object of the invention is to provide an apparatus which is constructed and assembled in such a way that it can ensure uniform treatment of rapidly running webs of moist fibrous material in paper making and like machines.

Another object of the invention is to provide novel and improved means for distributing steam or another suitable treating fluid in the interior of the above outlined apparatus.

A further object of the invention is to provide novel and improved fluid distributing valves which can be used in the above outlined apparatus.

An additional object of the invention is to provide a paper making machine which embodies one or more apparatus of the above outlined character.

Still another object of the invention is to provide novel and improved fluid distributing valves which can be installed in certain types of existing steam boxes as superior substitutes for heretofore known valves.

A further object of the invention is to provide a novel and improved method of uniformly distributing steam or another treating fluid in the plenum chambers of a steam box.

Another object of the invention is to provide the above outlined valves with novel and improved means for ensuring uniform distribution of steam or another treating fluid in the surrounding area.

An additional object of the invention is to provide novel and improved means for defining plenum chambers for the above outlined valves.

A further object of the invention is to provide an apparatus whose operation is quieter than that of heretofore known apparatus.

The invention is embodied in an apparatus for contacting a running web (particularly a web of moist fibrous material which is in the process of being converted into a strip of paper or the like), which is advanced in a predetermined direction along a predetermined arcuate or plane path, with a fluid medium (such as hot steam). The apparatus comprises a housing which includes an apertured wall adjacent the path of advancement of the web, and a plurality of sidewalls which define with the apertured wall a plurality of chambers (such chambers preferably form at least one row extending substantially transversely of the direction of advancement of the web along its path), and means for supplying fluid to the chambers so that the fluid can penetrate through the apertured wall and contact the running web in the path. The supplying means comprises at least one valve in each of the chambers and means (such as discrete conduits) for delivering fluid to each of the valves. Each valve comprises a body which defines an internal space arranged to receive fluid from the respective delivering means, and each valve body has a plurality of fluid discharging ports which are preferably remote from the apertured wall and connect the respective space with the respective chamber so as to direct streams of fluid toward the sidewalls around the respective chamber and to thus ensure that the fluid is distributed in the respective chamber prior to passing through the apertured wall.

The ports in the body of each valve preferably form at least one annulus having a first axis which is or can be at least substantially normal to the corresponding portion of the apertured wall. The ports have additional axes each of which is inclined with reference to the respect first axis at an angle of at least 60 degrees and slopes toward the apertured wall. Each valve body is preferably formed with at least twelve ports, normally between 16 and 48 ports and most preferably 32 ports. The aforementioned angles between the first axes and the axes of the respective ports are preferably acute angles in the range of approximately 69 to approximately 75 degrees. Each valve body can be formed with at least two annuli of ports, and such annuli are offset relative to each other in the direction of the respective first axis. The arrangement is preferably such that the ports of one annulus in each valve body are angularly offset with reference to the ports of another annulus. At least some of the ports can constitute or resemble the orifices of nozzles for coherent streams of treating fluid. For example, at least some of the ports can resemble or constitute round holes or bores each of which has an axial length exceeding its diameter. The diameters of such bores or holes can be in the range of 3–8 mm, preferably approximately 5 mm.

The apertured wall can be formed with several rows of apertures which extend transversely of the direction of advancement of the web along its path.

The sidewalls for each chamber preferably include pairs of confronting first and second sidewalls which are respectively located upstream and downstream of the respective chambers (as considered in the direction of advancement of the web along its path). The pairs of confronting sidewalls have spaced-apart first portions adjacent the apertured wall and spaced-apart second portions which are remote from the apertured wall. The mutual spacing of first portions of such pairs of confronting sidewalls preferably exceeds the mutual spacing of their second portions, i.e., the pairs of confronting sidewalls slope toward each other in a direction away from the apertured wall of the apparatus. Such confronting sidewalls are preferably flat or substantially flat.

If the apertured wall is disposed at a level below the chambers, it can be provided with troughs which are disposed in the chambers and are adjacent the respective sidewalls so that they can collect condensate which trickles along the sidewalls if the admitted fluid is steam.

The valves can form several files which extend transversely of the path of movement of the web. The arrangement may be such that the valves in alternate chambers of the aforementioned row of chambers form a first file and the remaining valves form a second file which is spaced apart from the first file in the direction of advancement of the web.

Each valve body can include a substantially cylindrical portion which is provided with the respective ports and has an end portion connected with the respective fluid delivering means. The valve bodies are further provided with seats in the regions of the end portions of the respective cylindrical portions, and each valve can further comprise a reciprocable or otherwise movable valving element and adjusting means for moving the valving element into and from sealing engagement with the respective seat so as to respectively prevent and permit the admission of fluid into the respective internal space. The cylindrical portions of the valve bodies are preferably remote from the apertured wall.

Each valve can further comprise a thermal barrier between the respective adjusting means and the internal space of its body. For example, each thermal barrier can comprise an annular recess or groove which spacedly surrounds the nearest portion of the respective adjusting means and is spacedly surrounded by the respective cylindrical portion. The recesses can be provided in threaded end walls which can be attached to the cylindrical portions of respective valve bodies and to the casings of the respective adjusting or moving means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
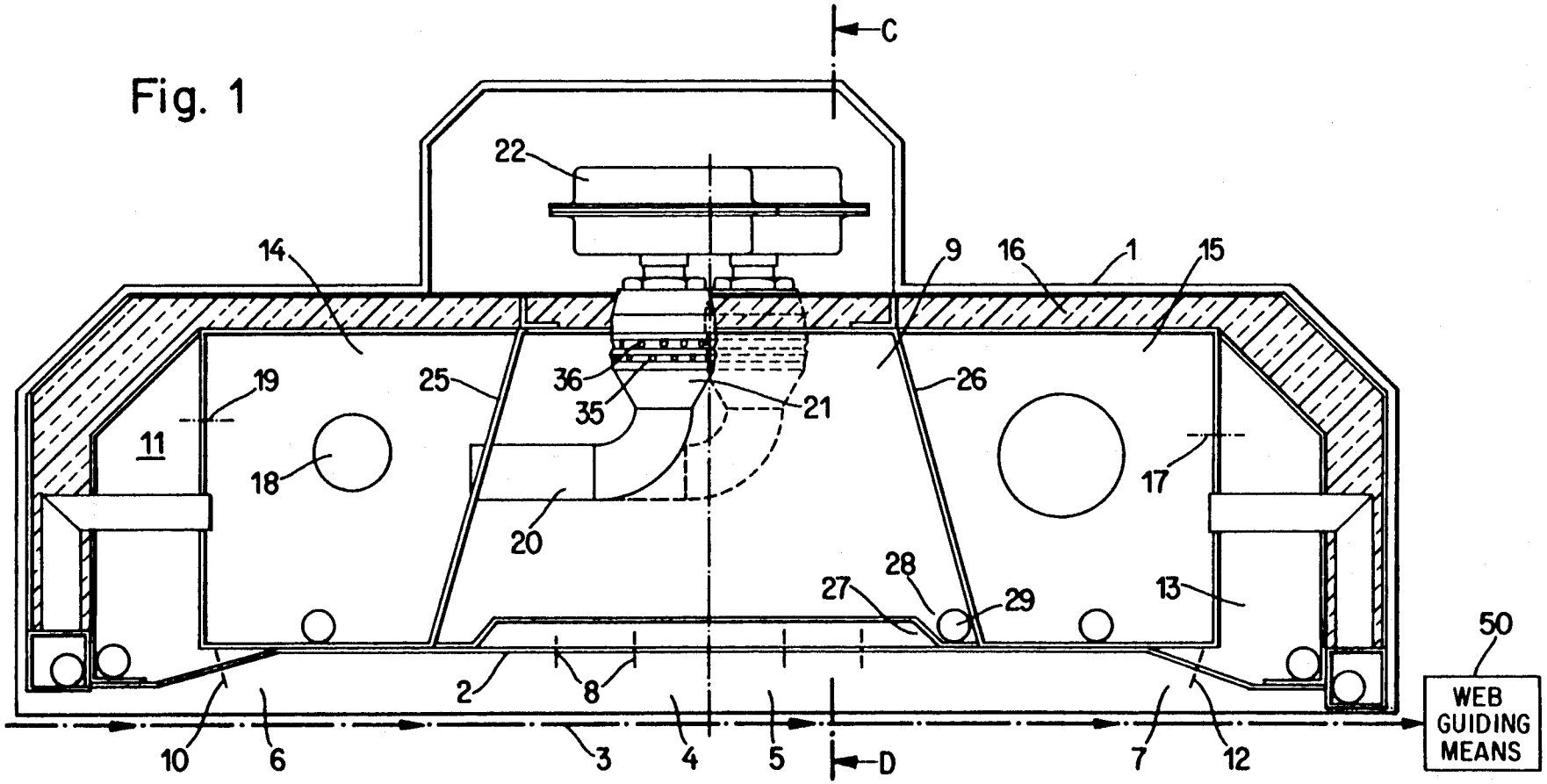
FIG. 1 is a somewhat schematic longitudinal vertical sectional view of an apparatus which embodies one form of the invention and has two files of valves with each file extending transversely of the direction of advancement of a web of moist fibrous material along its path, the section being taken in the direction of arrows as seen from the line A-B in FIG. 2.
Figure 2:
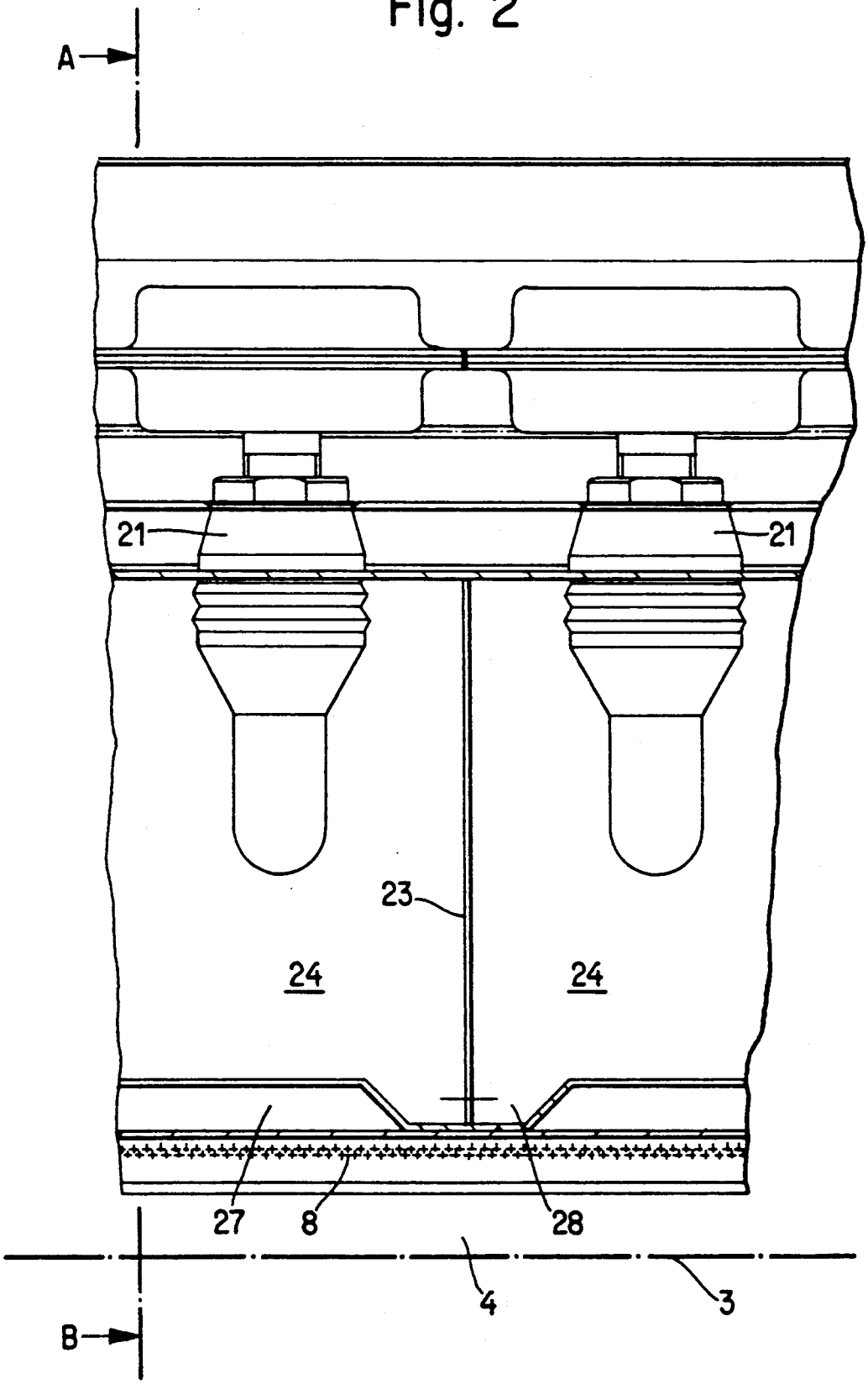
FIG. 2 is an enlarged fragmentary transverse vertical sectional view as seen in the direction of arrows from the line C-D of FIG. 1.

The apparatus of FIGS. 1 and 2 comprises a housing 1 which has an apertured bottom wall 2 adjacent the horizontal path of movement of a running web 3 of moist fibrous material which is in the process of being converted into a sheet of paper in a paper making machine in a manner as more fully disclosed in the copending patent application Ser. No. 082,786. The underside of the apertured wall 2 defines with the upper side of the running web 3 a relatively narrow treating zone 4 which has a centrally located main section 5, a second or upstream section 6 (as considered in the direction of travel of the web 3), and a third or downstream section 7. The web 3 is guided horizontally and to the right in FIG. 1 by web guiding means 50.

The central portion of the wall 2 is formed with several rows of apertures 8 which serve to discharge jets of steam against the upper side of the running web 3 in the main section 5 of the treating zone 4. The configuration of the apertures 8 is or can be such that the jets are directed substantially at right angles to the plane of the adjacent portion of the running web 3. The rows of apertures 8 extend transversely of the path of movement of the web 3, i.e., at right angles to the plane of FIG. 1.

The upstream portion of the wall 2 has one or more (e.g., two) transversely extending rows of apertures 10 which discharge jets of steam at an acute angle to the plane of the running web 3 and in such a way that they tend to draw some atmospheric air into the respective section 6 of the treating zone 4, all as described and claimed in the copending patent application Ser. No 082,786. The downstream portion of the wall 2 has one or more (e.g., two) transversely extending rows of apertures 12 which also discharge jets of steam at an acute angle to the plane of the web 3 and in such a way that they tend to draw air into the section 7 of the treating zone 4. The just discussed inclination of the jets which issue from the apertures 10 and 12 relative to the jets issuing from the apertures 8 reduces the likelihood of escape of large quantities of steam from the treating zone 4 into the surrounding atmosphere and renders it possible to treat the web 3 with a higher degree of predictability.

The apertures 10 receive steam from a plenum chamber 11, and the apertures 12 receive steam from a plenum chamber 13. The plenum chambers 11 and 13 respectively receive steam from compartments 14 and 15 which extend transversely of the direction of advancement of the web 3, the same as the chambers 11, 13, and the compartments 14, 15 flank a relatively large composite plenum chamber 9 which is subdivided into a row of smaller plenum chambers 24 by a set of sidewalls 23 in the form of partitions disposed at right angles to the plane of FIG. 2 (i.e., in parallelism with the plane of FIG. 1) and extending at least substantially all the way from the top wall of the housing 1 to the apertured wall 2. The plenum chambers 11, 13, 24 and the compartments 14, 15 are surrounded from above and at the sides by a jacket 16 of suitable heat insulating material.

The compartment 14 is connected or connectable to a main source of treating fluid (such as hot steam) and serves to supply fluid to the plenum chamber 11 by way of openings 19 in a transversely extending wall within the confines of the jacket 16. A tubular connector 18 is provided to admit treating fluid (hereinafter called steam for short) from the compartment 14 into the compartment 15, and the latter admits steam into the plenum chamber 13 by way of one or more rows or other arrays of openings 17 in a vertical wall between 13 and 15. Still further, the compartment 14 serves to admit steam to several discrete conduits 20 which serve to deliver steam to discrete valves 21 in the respective plenum chambers 24. Each plenum chamber 24 can contain two or more valves 21; however, the illustrated apparatus is designed to have one valve per plenum chamber 24.

The housing 1 of the apparatus comprises a cupola or dome which is located at a level above the composite plenum chamber 9 (i.e., above the row of smaller plenum chambers 24) and confines a row of pneumatic adjusting or moving devices 22, one for each of the valves 21.

Each plenum chamber 24 is bounded from below by the respective portion of the apertured wall 2, from above by the respective portion of the top wall of the housing 1, at two lateral sides by two of the partitions or sidewalls 23, and at its upstream and downstream sides (as seen in the direction of advancement of the web 3) by two mutually inclined confronting sidewalls 25, 26. The lower portions of the sidewalls of each pair of confronting sidewalls 25, 26 are spaced apart from each other a distance which exceeds the distance between the upper portions of such sidewalls. This can be readily seen in FIG. 1. The sidewalls 25, 26 are preferably flat and they can make relatively small acute angles with the vertical axes of apertures 8 in the median portion of the wall 2. The latter is formed with troughs 28 which are adjacent the lower portions of sidewalls 23, 25, 26 in each of the plenum chambers 24 and serve to collect condensate which gathers on and trickles downwardly along the respective sidewalls. Conduits 29 (one shown in FIG. 1) are provided for evacuation of condensate from the apparatus. Such evacuation is desirable and advantageous because condensate could affect the appearance and/or other characteristics of the web 3 if it were permitted to penetrate through the apertures 8 of the wall 2 and into the treating zone 4 to deposit on the running web 3. The reference character 27 denotes in FIG. 1 a portion of the wall 2 which defines the illustrated trough 28 with the adjacent sidewall 26.

Figure 3:
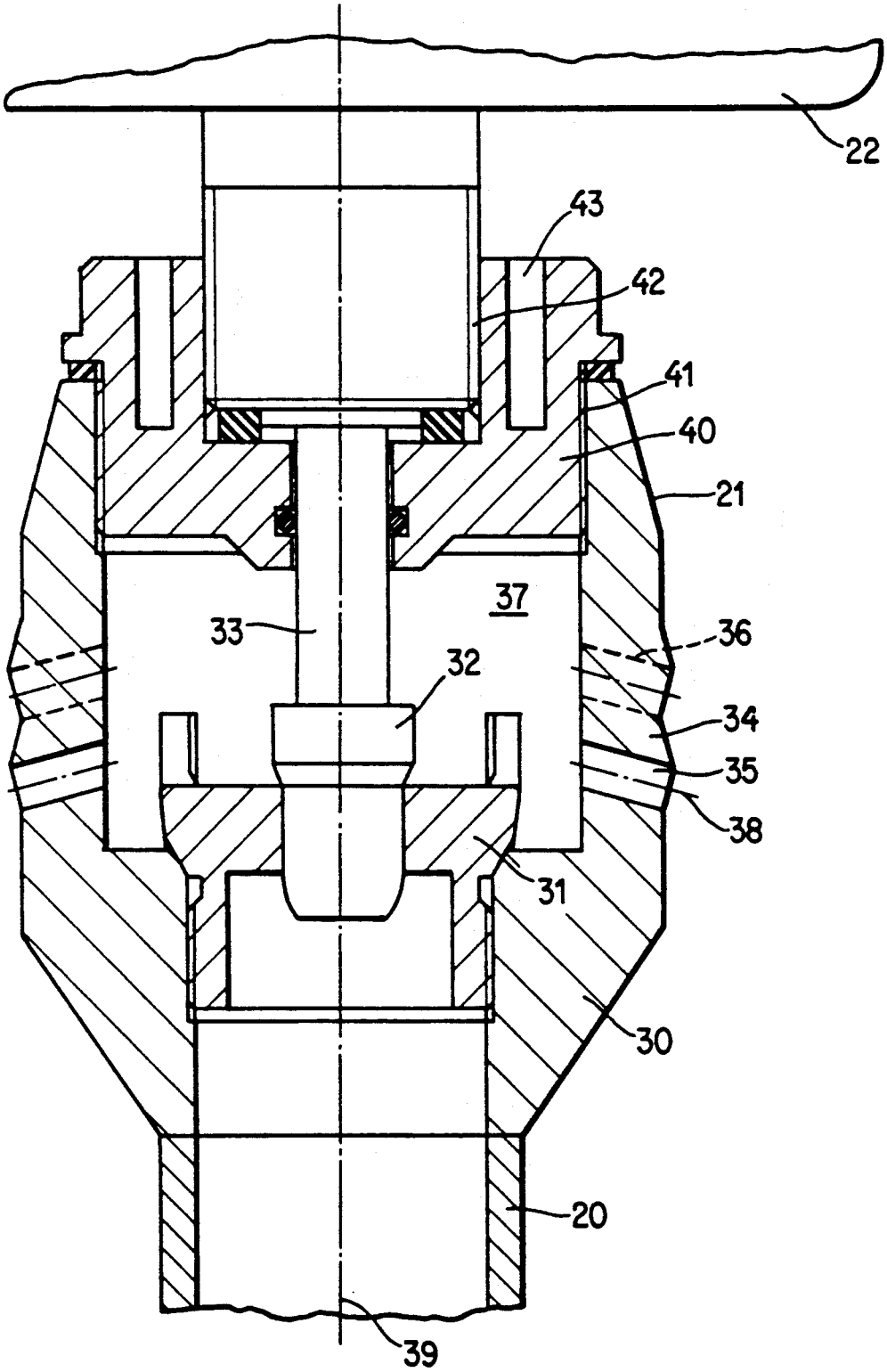
FIG. 3 is an enlarged axial sectional view of one of the valves and of a portion of the respective fluid delivering means, and an elevational view of a portion of the associated adjusting or moving means for the valving element of the illustrated valve.

Each valve 21 comprises a body 30 (see FIG. 3) whose lower end portion is welded to the respective steam delivering conduit 20 and which has a vertical axis 39 extending substantially or exactly at right angles to the nearest portion of the apertured bottom wall 2 of the housing 1. The lower end portion of the body 30 has an internal thread for the externally threaded portion of an annular valve seat 31 which cooperates with a vertically reciprocable valving element 32 to respectively permit or prevent the flow of steam from the conduit 20 into an internal space 37 which is surrounded by a substantially cylindrical portion 34 of the body 30. The valving element 32 is mounted at the lower end of a motion transmitting rod 33 which forms one component of the respective pneumatic adjusting or moving device 22 in the domed portion of the housing 1. The adjusting or moving device 22 can comprise a fluid-operated double-acting cylinder and piston unit (not specifically shown) which can be operated by remote control to raise or lower the valving element 32 in order to enable pressurized steam to enter the space 37 or to seal such space from the interior of the respective conduit 20.

In accordance with a feature of the invention, the cylindrical portion 34 of the valve body 30 has two annuli of steam discharging ports 35, 36 whose axes 38 are inclined with reference to the axis 39. The centers of the two annuli of ports 35, 36 are located on the axis 39, and each of the axes 38 slopes downwardly toward the wall 2 and makes with the axis 39 an acute angle of more than 60 degrees, preferably an angle of 69–75 degrees (most preferably about 72 degrees). Each of the ports 35, 36 can constitute an orifice in the form of a cylindrical hole or bore having a diameter of 3–8 mm, preferably approximately 5 mm. The axial length of each such bore or hole is preferably 10 mm. This ensures that the body portions surrounding the ports 35, 36 act as nozzles which direct coherent streamlets of steam toward the respective sidewalls 23, 25, 26 in a region which is remote from the apertured wall 2 so that the admitted steam is distributed in the internal space 37 and can flow through all of the apertures 8 in the respective portion of the wall 2.

Each valve body 30 further comprises a detachable cover or insert 40 having external threads 41 in mesh with internal threads of the cylindrical portion 34 and internal threads 42 in mesh with external threads on an adjacent cylindrical portion of the respective adjusting or moving device 22. The cover 40 has a thermal barrier in the form of a ring-shaped recess or groove 43 which prevents the transfer of excessive quantities of heat between the major portion of the valve body 30 and the respective adjusting or moving device 22. Other forms of thermal barriers can be employed with equal or similar advantage.

The total number of ports 35, 36 preferably at least equals but can exceed 12. For example, the cylindrical portion 34 of each valve body 30 can be provided with 16–48 (preferably 32) ports 35, 36. The number of ports 35 can but need not equal the number of ports 36, and the ports 35 can be staggered with reference to the ports 36 in the circumferential direction of the cylindrical portion 34 to ensure a more uniform distribution of steam in the respective chamber 24. The inclination of the axes 38 of ports 35 with reference to the plane of the web 3 may but need not match the inclination of the axes of the ports 36.

When the apparatus is in use (i.e., when the actuating or moving devices 22 permit steam to flow from the conduits 20 into the internal spaces 37 of the respective valve bodies 30), the ports 35, 36 discharge coherent jets or streamlets of steam which flow toward the respective sidewalls 23, 25, 26 and entrain steam which is already confined in the respective plenum chambers 34. This ensures highly uniform distribution of steam in the chambers 24 and predictable treatment of successive increments of the running web 3 in the main section 5 of the treating zone 4. The rate at which steam issues from the apertures 8 is uniform all the way across the path of the running web 3, and this also contributes to uniformity and predictability of treatment and hence to quality of the ultimate product.

In accordance with a presently preferred embodiment of the invention, the number of ports in the cylindrical portion 34 of each valve body 30 is related to the diameters of the ports in such a way that the diameters are smaller if the number of ports is greater and vice versa. A large number of ports is preferred on the additional ground that the correspondingly large number of streams which issue from the ports can more accurately determine the rate and the direction of flow of steam in the interior of the respective plenum chamber 24 and toward the apertured wall 2.

The ports 35 need not be angularly offset relative to the adjacent ports 36. However, a staggering of such ports in the circumferential direction of the respective cylindrical portions 34 (as shown in FIG. 1) is preferred in many instances because this renders it possible to provide a large number of ports (35 plus 36) in a small-diameter cylindrical portion 34. Annuli of ports which are angularly offset relative to each other can be readily formed in available drilling or like machines.

The making of ports in the form of nozzles which discharge coherent streams of steam is preferred in many instances because this ensures that the orientation of streams issuing from the ports 35, 36 remains unchanged in the interior of the respective plenum chambers 24, i.e., each such stream is more likely to influence the flow of steam which is already confined in the respective chamber 24 in a highly predictable manner. These streams begin to diverge at a considerable distance from the external surface of the respective cylindrical body portion 34, i.e., close to the sidewalls 23, 25, 26 which surround the respective chamber 24. As mentioned above, the just described desirable effect can be achieved if each port 35 and/or 36 constitutes an elongated round bore or hole having a diameter between 3–8 mm, preferably approximately 5 mm, and an axial length which can be as much as twice or even more than twice the diameter.

An advantage of the improved apparatus and of its valves 21 is that the distribution of steam in each of the plenum chambers 24 is uniform so that steam which is admitted into the median section 5 of the treating zone 4 can subject successive increments of the running web 3 to a highly predictable treatment to thus ensure predictable heating of each and every portion of the web 3 all the way across the path of the web and hence a more predictable and more rapid drying of the web to an optimum final moisture content. Uniform distribution of steam in each plenum chamber 24 is ensured because the streams of steam issuing from the ports 35 and 36 in each plenum chamber 24 have large components extending at right angles to the respective axes 39, i.e., in substantial or exact parallelism with that portion of the apertured wall 2 which is adjacent the undersides of the chambers 24. Since the number of ports 35, 36 in each plenum chamber 24 is rather large (as mentioned above, the cylindrical portion 34 of each valve body 30 is preferably provided with at least twelve but preferably with a much larger number (e.g., 32) of ports which can form at least two annuli with centers on the respective axis 39), the admission of a large number of individual streams of steam each of which has a large component in a direction at right angles to the corresponding axis 39 ensures a highly uniform distribution of steam not later than in those regions of the plenum chambers 24 which are adjacent the wall 2, i.e., adjacent the apertures 8 in the median portion of the wall 2. Such distribution and orientation of streams of treating fluid issuing from the ports 35, 36 in the cylindrical portions 34 of valve bodies 30 is in contrast to prior proposals according to which a relatively small number of ports is employed to direct large jets of steam directly or nearly directly against the apertured wall which is adjacent the treating zone.

Another advantage of valves which have large numbers of ports is that the noise which is generated by streams of steam issuing from such ports is much less pronounced than in conventional apparatus, e.g., by up to and even by more than five decibels. Experiments indicate that the orientation of streams of steam issuing from the ports 35, 36 is especially satisfactory if the axes 38 of the ports and the respective axes 39 make acute angles of 69–75 degrees, most preferably approximately 72°.

The provision of several rows of apertures 8 in the median portion of the wall 2 beneath the plenum chambers 24 also contributes to uniformity of contact between the mass of steam in the main section 5 of the treating zone 4 and the running web 3. It is clear, however, that the apertures 8 need not necessarily form rows but can be arrayed in a number of other ways as long as they ensure a satisfactory distribution of the mass of steam which flows from the chambers 24 into the adjacent section 5 of the treating zone 4. FIG. 1 shows that the length of the chambers 24 in the direction of advancement of the web 3 exceeds the length of the chambers 11 and 13. This renders it possible to provide the median portion of the wall 2 with a large number of rows of apertures 8 to even further enhance the uniformity of distribution of steam in the adjacent portions of the chambers 24 and hence also in the median section 5 of the treating zone 4.

The utilization of pairs of confronting sidewalls 25, 26 which slope toward each other in directions away from the wall 2 is desirable and advantageous because this ensures a more predictable flow of steam from the levels of the annuli of ports 35, 36 toward the upper side of the wall 2. In other words, the distribution of steam adjacent the wall 2 is not less or not much less uniform than at the levels of the ports 35, 36. This is attributable to gradual widening of the chambers 24 in directions from the levels of the ports 35, 36 toward the wall 2.

The troughs 28 in the regions where the sidewalls 23, 25, 26 are nearest to the apertured wall 2 constitute a desirable feature of the apparatus because the sidewalls 23, 25, 26 are likely to gather a certain amount of condensate, especially if their temperature is below that of steam issuing from the ports 35 and 36. Of course, such troughs will be provided only if the apertured wall 2 is located at a level below the plenum chambers 24.

Figure 4:
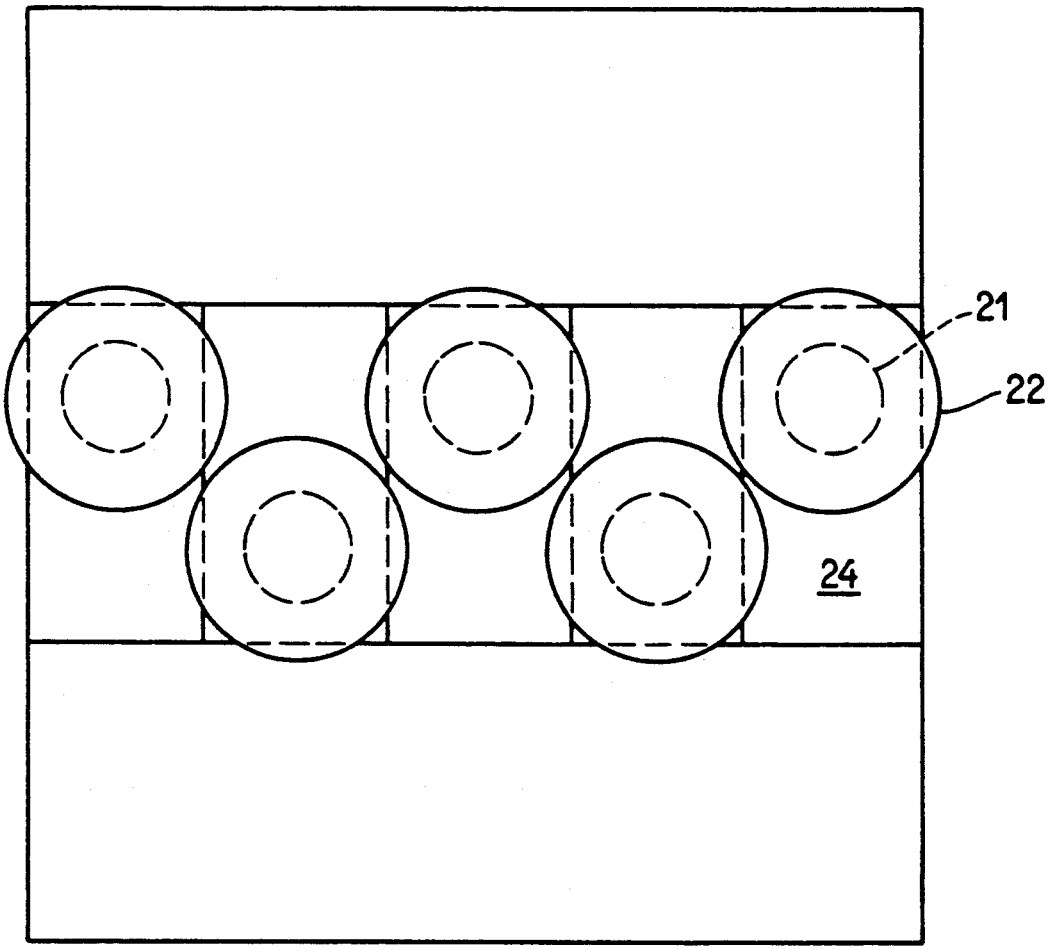
FIG. 4 is a plan view showing the files of valves.

The arraying of valves 21 into several rows or files, as shown in FIG. 4, which extend transversely of the direction of advancement of the web 3 brings about the advantage that it is possible to stagger the adjusting or moving devices 22 in the domed upper portion of the housing 1. This is desirable and advantageous if the diameters of the devices 22 are large so that the mutual spacing of valves 21 forming a single file or row would have to be increased accordingly. It has been found that the placing of valves 21 slightly off center in the respective chambers 24 (i.e., nearer to the respective sidewalls 25 than to the confronting sidewalls 26 or vice versa) does not adversely or appreciably influence the uniformity of distribution of steam which is admitted via ports 35 and 36. The provision of a large number of valves 21, i.e., the provision of a large number of chambers 24, is desirable because this renders it possible to control the moisture profile of the web 3 (as considered at right angles to the direction of its advancement along the apertured wall 2) with an even higher degree of accuracy and predictability.

The masses of steam which are delivered by the conduits 20 into the respective internal spaces 37 (when the respective valving elements 32 are maintained in raised positions) are deflected only once, namely through angles of approximately 90 degrees during flow from the discharge ends of the conduits 20 into the respective ports 35 and 36. This entails a relatively small deceleration of the flowing steam, namely a deceleration which is a small fraction of that when the flow of steam must be altered by 180 degrees or close to 180 degrees as in conventional valves.

The thermal barriers 43 are desirable because they render it possible to operate with steam at an elevated temperature such as could affect the operation of the adjusting or moving devices 22.

Any water droplets which gather in the ports 35, 36 as a result of cooling of steam on contact with the bodies 30 of the valves 21 are expelled from the ports by the inflowing hot steam so that such droplets are propelled toward and against the respective sidewalls 23, 25, 26 rather than directly against the apertured wall 2. The droplets which gather on the sidewalls 23, 25, 26 trickle toward and into the troughs 28 and are evacuated by way of the respective conduits 29 so that they do not reach the running web 3. The provision of troughs 28 is especially desirable in connection with the making of high grade paper. Moreover, such troughs and the associated conduits 29 reduce the likelihood of dripping of condensate from the apparatus 1 outside of the path for the web 3 because the conduits 29 are designed to direct the collected condensate to one or more collecting receptacles. Conventional apparatus merely provide holes in the housing for more or less haphazard evacuation of condensate.

The improved apparatus is susceptible of many modifications without departing from the spirit of the invention. For example, the apertured wall 2 can constitute a concavo-convex screen or plate or a similar plate (reference may be had to FIG. 6 of the copending patent application Ser. No. 082,786). This is desirable if the web 3 is caused to travel along an arcuate path, for example, along the periphery of a cylinder which surrounds a suction chamber serving to draw moisture from successive increments of the web.

Furthermore, the illustrated pneumatic moving or actuating devices 22 for the valves 21 can be replaced with electrical, electromagnetic, mechanical, hydraulic or other adjusting or moving devices which can be operated automatically from a central control unit of the machine or production line which embodies the improved apparatus.

The compartments 14 and 15 can be connected in parallel rather than in series (as shown in FIG. 1).

Still further, one or more files of valves 21 or analogous valves can be provided in the plenum chamber 11 and/or 17 to ensure a more uniform distribution of steam prior to penetration through the respective apertures 10, 12 and into the corresponding sections 6, 7 of the treating zone 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for contacting a running web with a fluid medium, comprising means for guiding the web in a predetermined direction along a predetermined path; a housing including an apertured wall adjacent said path and a plurality of sidewalls defining with said apertured wall a plurality of chambers; and means for supplying fluid into said chambers so that the fluid can penetrate through said apertured wall and contact the running web in said path, said supplying means comprising at least one valve in each of said chambers and means for delivering fluid to each of said valves, each of said valves comprising a body defining an internal space arranged to receive fluid from the respective delivering means and each of said bodies having a plurality of fluid discharging ports connecting the respective internal space with the respective chamber and arranged to direct streams of fluid substantially toward the sidewalls around the respective chamber so that the fluid is distributed in the respective chamber prior to reaching said apertured wall, the ports in each of said bodies forming at least one annulus having a first axis which is substantially normal to said apertured wall, and each of said ports having an axis which is inclined with reference to the respective first axis at an angle of at least 60 degrees and slopes toward said apertured wall.

2. The apparatus of claim 1, wherein the ports in each of said bodies are remote from said apertured wall.

3. The apparatus of claim 1, wherein each of said bodies has at least twelve of said ports.

4. The apparatus of claim 1, wherein each port axis is inclined with reference to the respective first axis at an angle of approximately 69 to approximately 75 degrees.

5. The apparatus of claim 1, wherein each of said bodies has between 16 and 48 of said ports.

6. The apparatus of claim 1, wherein at least some of said ports are designed to discharge coherent streams of fluid.

7. The apparatus of claim 1, wherein at least some of said ports are circular holes or bores each having a length exceeding its diameter.

8. The apparatus of claim 1, wherein at least some of said ports are circular bores or holes each having a diameter of 3–8 mm.

9. The apparatus of claim 1, wherein said apertured wall has several rows of apertures and said rows extend substantially transversely of said path.

10. The apparatus of claim 1, wherein said chambers form a row extending substantially transversely of said path, said sidewalls including pairs of confronting first and second sidewalls which are respectively located upstream and downstream of the respective chambers in said predetermined direction, said pairs of confronting sidewalls having spaced-apart first portions adjacent said apertured wall and spaced-apart second portions remote from said apertured wall, the mutual spacing of the first portions of each pair of confronting sidewalls being greater than the mutual spacing of the second portions of the respective pairs of confronting sidewalls.

11. The apparatus of claim 10, wherein said confronting sidewalls are substantially flat.

12. The apparatus of claim 2, wherein said apertured wall is disposed at a level below said chambers and includes in each of said chambers a fluid-collecting trough adjacent the respective sidewalls.

13. The apparatus of claim 1, wherein said chambers form a first row extending substantially transversely of said path and said valves form several additional rows which extend transversely of said path.

14. The apparatus of claim 13, wherein the valves in alternate chambers of said first row form one of said additional rows and the valves in the remaining chambers of said first form another of said additional rows.

15. The apparatus of claim 1, wherein each of said bodies includes a substantially cylindrical portion which is provided with the respective ports and has an end portion connected with the respective fluid delivering means, said bodies having seats in the regions of the end portions of the respective cylindrical portions and each of said valves further comprising a valving element and means for moving the valving element into and from sealing engagement with the respective seat so as to respectively prevent and permit the admission of fluid into the respective space.

16. The apparatus of claim 15, wherein said cylindrical portions are remote from said apertured wall.

17. The apparatus of claim 1, wherein each of said valves further comprises a mobile valving element and means for moving the valving element to and from a position in which the valving element seals the respective internal space from the respective fluid delivering means, each of said valves further comprising a thermal barrier between the respective moving means and the corresponding internal space.

18. The apparatus of claim 1, wherein said guiding means is designed to transport webs of moist fibrous material.

19. The apparatus of claim 1, comprising a source of steam in communication with said supplying means.

20. The apparatus of claim 5, wherein each of said bodies has 32 of said ports.

21. The apparatus of claim 8, wherein at least some of said ports are circular bores or holes each having a diameter of approximately 5 mm.

22. Apparatus for contacting a running web with a fluid medium, comprising means for guiding the web in a predetermined direction along a predetermined path; a housing including an apertured wall adjacent said path and a plurality of sidewalls defining with said apertured wall a plurality of chambers; and means for supplying fluid into said chambers so that the fluid can penetrate through said apertured wall and contact the running web in said path, said supplying means comprising at least one valve in each of said chambers and means for delivering fluid to each of said valves, each of said valves comprising a body defining an internal space arranged to receive fluid from the respective delivering means and each of said bodies having a plurality of fluid discharging ports connecting the respective internal space with the respective chamber and arranged to direct streams of fluid substantially toward the sidewalls around the respective chamber so that the fluid is distributed in the respective chamber prior to reaching said apertured wall, the ports in each of said bodies being remote from said apertured wall and forming at least one annulus having a first axis which is substantially normal to said apertured wall, and each of said ports having an axis which is inclined with reference to the respective first axis at an angle of at least 60 degrees and slopes toward said apertured wall, each of said bodies having at least one additional annulus of said ports, and said annuli being offset relative to each other in the direction of the respective first axis, the ports of one annulus in each body being angularly offset with reference to the ports of another annulus.

23. Apparatus for contacting a running web with a fluid medium, comprising means for guiding the web in a predetermined direction along a predetermined path; a housing including an apertured wall adjacent said path and a plurality of sidewalls defining with said apertured wall a plurality of chambers; and means for supplying fluid into said chambers so that the fluid can penetrate through said apertured wall and contact the running web in said path, said supplying means comprising at least one valve in each of said chambers and means for delivering fluid to each of said valves, each of said valves comprising a body defining an internal space arranged to receive fluid from the respective delivering means and each of said bodies having a plurality of fluid discharging ports connecting the respective internal space with the respective chamber and arranged to direct streams of fluid substantially toward the sidewalls around the respective chamber so that the fluid is distributed in the respective chamber prior to reaching said apertured wall, the ports in each of said bodies being remote from said apertured wall and forming at least one annulus having a first axis which is substantially normal to said apertured wall, and each of said ports having an axis which is inclined with reference to the respective first axis at an angle of at least 60 degrees and slopes toward said apertured wall, each of said valves further comprising a mobile valving element and means for moving the valving element to and from a position in which the valving element seals the respective internal space from the respective fluid delivering means, and each of said valves additionally comprising a thermal barrier between the respective moving means and the corresponding internal space, each of said valves also comprising an insert through which a portion of said moving means extends and each of said thermal barriers including an annular recess in the respective insert.

24. The apparatus of claim 23, wherein said portion of each of said moving means is surrounded by the respective recess and each recess is surrounded by the respective body.

* * * * *